US009399505B2

(12) United States Patent
Kaneko et al.

(10) Patent No.: US 9,399,505 B2
(45) Date of Patent: Jul. 26, 2016

(54) JET PROPULSION WATERCRAFT

(71) Applicant: YAMAHA HATSUDOKI KABUSHIKI KAISHA, Iwata-shi, Shizuoka (JP)

(72) Inventors: Yoshiyuki Kaneko, Shizuoka (JP); Masaru Suzuki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 246 days.

(21) Appl. No.: 14/292,997

(22) Filed: Jun. 2, 2014

(65) Prior Publication Data

US 2015/0086373 A1 Mar. 26, 2015

(30) Foreign Application Priority Data

Sep. 20, 2013 (JP) ..... 2013-195381

(51) Int. Cl.
*B63H 11/107* (2006.01)
*B63H 11/11* (2006.01)

(52) U.S. Cl.
CPC ..... *B63H 11/11* (2013.01)

(58) Field of Classification Search
CPC ..... B63H 11/00; B63H 11/10; B63H 11/107; B63H 11/11; B63H 11/113; B63H 11/117; B63H 2011/00; F04D 25/045
USPC ..... 440/38, 40, 41, 42, 43
See application file for complete search history.

(56) References Cited

U.S. PATENT DOCUMENTS 3,465,705 A 9/1969 Castoldi
3,937,172 A 2/1976 Castoldi
5,752,864 A * 5/1998 Jones ..... B63H 11/11 440/41
5,755,601 A 5/1998 Jones
5,934,954 A * 8/1999 Schott ..... B63H 11/11 440/41
6,183,318 B1 2/2001 Tsumiyama et al.
6,428,370 B1 * 8/2002 Jones ..... B63H 11/11 440/38
6,530,812 B2 * 3/2003 Koyano ..... B63H 25/46 440/38
2012/0276793 A1 11/2012 Minoura et al.

FOREIGN PATENT DOCUMENTS

JP 50-35893 A 4/1975
JP 2000-62690 A 2/2000
JP 2000-190895 A 7/2000
JP 2012-236586 A 12/2012

* cited by examiner

*Primary Examiner* — Daniel V Venne
(74) *Attorney, Agent, or Firm* — Keating and Bennett, LLP

(57) ABSTRACT

A jet propulsion watercraft includes a vessel body, a steering nozzle, and a bucket. The steering nozzle includes a jet port from which a jet of water is ejected to propel the vessel body. The bucket is configured to move to a retracted position away from the jet of water ejected from the jet port and a jet receiving position to receive the jet of water ejected from the jet port. The bucket includes a right opening, a left opening, a first opening, and a second opening spaced apart from the first opening. The jet of water flows rightward from the right opening, leftward from the left opening, and rearward from the first opening and the second opening when the bucket is located in the jet receiving position. The first opening is located at least partially rightward of a right end of the jet port. The second opening is located at least partially leftward of a left end of the jet port.

7 Claims, 10 Drawing Sheets

JET PROPULSION WATERCRAFT

CROSS-REFERENCE TO RELATED APPLICATIONS

The present application claims priority under 35 U.S.C. §119 to Japanese Patent Application No. 2013-195381, filed on Sep. 20, 2013. The entire disclosure of Japanese Patent Application No. 2013-195381 is hereby incorporated herein by reference.

BACKGROUND OF THE INVENTION

1. Field of the Invention

The present invention relates to a jet propulsion watercraft.

2. Description of the Related Art

A known jet propulsion watercraft is of a type including a steering nozzle that is pivotable right and left in response to a handle operation, and a bucket that switches the direction of a jet of water to be ejected from the steering nozzle (see Japan Laid-open Patent Application Publication No. JP-A 2000-190895). The bucket described in Japan Laid-open Patent Application Publication No. JP-A 2000-190895 includes right and left discharge ports bored therein and is configured to eject a jet of water from the right and left discharge ports.

However, if the steering nozzle is pivoted right and left while the jet propulsion watercraft described in Japan Laid-open Patent Application Publication No. JP-A-2000-190895 is decelerated by ejecting a jet of water from the right and left discharge ports, in other words, while the bucket is in use, a jet of water is ejected from one of the discharge ports with an excessive momentum, and the jet propulsion watercraft makes an acute turn.

SUMMARY OF THE INVENTION

Preferred embodiments of the present invention have been developed in view of the aforementioned situation, and provide a jet propulsion watercraft that inhibits making acute turns when a steering nozzle is pivoted right and left while using a bucket.

A jet propulsion watercraft according to a preferred embodiment of the present invention includes a vessel body, a steering nozzle, and a bucket. The steering nozzle is configured to be pivoted right and left. The steering nozzle includes a jet port from which a jet of water is ejected to propel the vessel body. The bucket is configured to move to a retracted position away from the jet of water ejected from the jet port and a jet receiving position to receive the jet of water ejected from the jet port. The bucket includes a right opening, a left opening, a first opening, and a second opening spaced apart from the first opening. The jet of water flows rightward from the right opening, flows leftward from the left opening, and flows rearward from the first opening and the second opening when the bucket is located in the jet receiving position. The first opening is at least partially located rightward of aright end of the jet port. The second opening is at least partially located leftward of a left end of the jet port.

Thus, a jet propulsion watercraft according to a preferred embodiment inhibits making acute turns when the steering nozzle is pivoted right and left while using the bucket.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
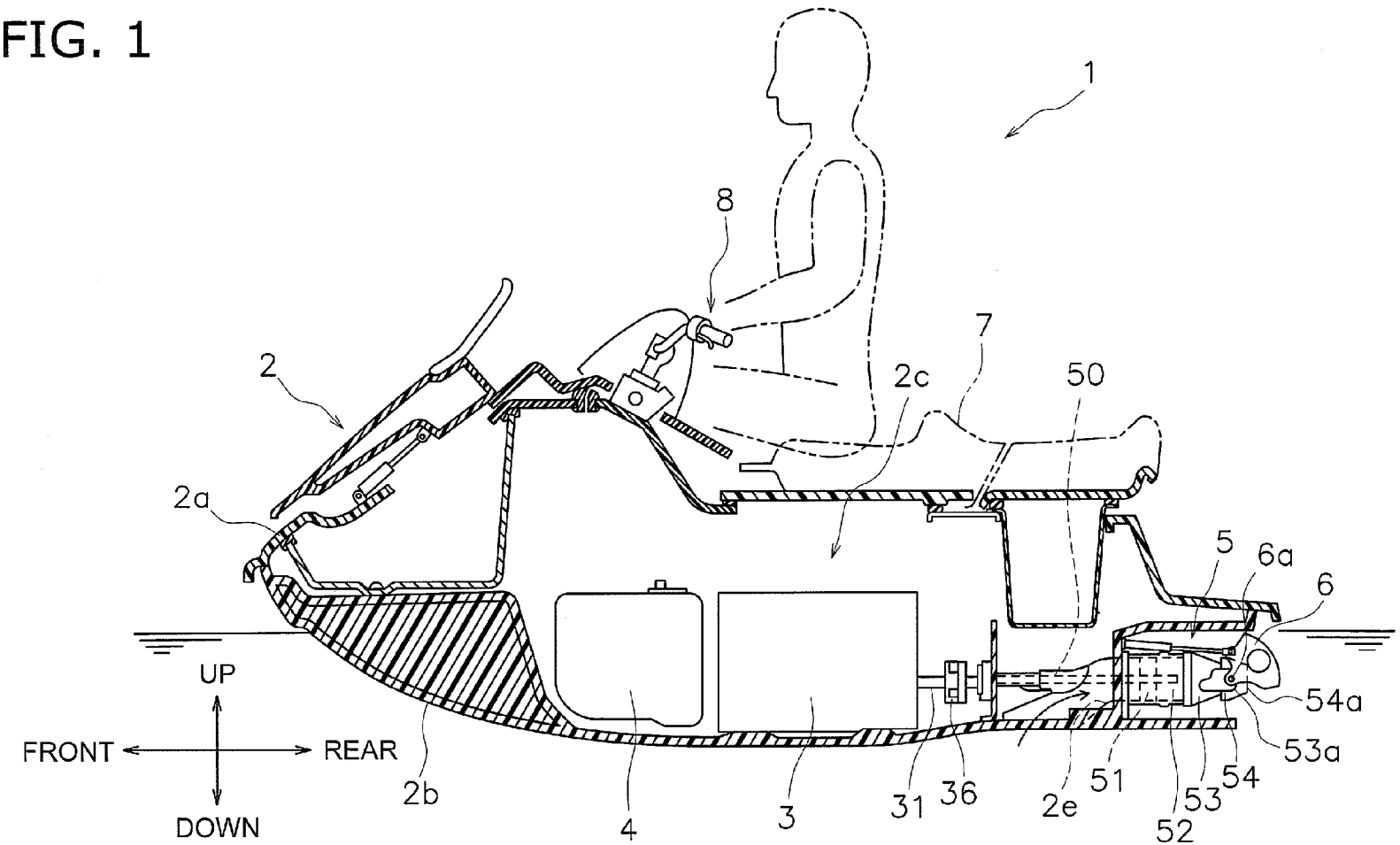
FIG. 1 is a cross-sectional view of a schematic structure of a jet propulsion watercraft.

With reference to the drawings, explanation will be hereinafter made for the schematic structure of a jet propulsion watercraft 1 according to exemplary preferred embodiments of the present invention. FIG. 1 is a cross-sectional view of the schematic structure of the jet propulsion watercraft 1 according to an exemplary preferred embodiment of the present invention. In the following explanation, the terms "front", "rear", "right" and "left" are defined with reference to the point of view of an operator seated on a seat 7.

The jet propulsion watercraft 1 is preferably so-called a personal watercraft (PWC), for example. The jet propulsion watercraft 1 includes a vessel body 2, an engine 3, a fuel tank 4, a jet propulsion mechanism 5, a bucket 6, the seat 7, and a steering handle 8.

The vessel body 2 includes a deck 2*a* and a hull 2*b*. The seat 7 is attached to the deck 2*a*. The seat 7 is disposed over the engine 3. The steering handle 8 is disposed forward of the seat 7. The steering handle 8 is an operating member used to steer the vessel body 2.

An engine compartment 2*c* is provided inside the vessel body 2. The engine compartment 2*c* accommodates the engine 3, the fuel tank 4, and so forth. The engine 3 includes a crankshaft 31 extending in the back-and-forth direction.

The jet propulsion mechanism 5 is configured to generate thrust to propel the vessel body 2 in response to a driving force from the engine 3. The jet propulsion mechanism 5 is configured to suck in and eject water that surrounds the vessel body 2. The jet propulsion mechanism 5 includes an impeller shaft 50, an impeller 51, an impeller housing 52, a jet nozzle 53, and a steering nozzle 54.

The impeller shaft 50 is disposed so as to extend rearward from the engine compartment 2*c*. The front portion of the impeller shaft 50 is coupled to the crankshaft 31 through a coupling portion 36. The rear portion of the impeller shaft 50 is introduced into the impeller housing 52 through a water suction portion 2*e* of the vessel body 2. The impeller housing 52 is connected to the rear portion of the water suction portion 2*e*.

The impeller 51 is attached to the rear portion of the impeller shaft 50. The impeller 51 is disposed inside the impeller housing 52. The impeller 51 is configured to be rotated together with the impeller shaft 50 and suck in water through the water suction portion 2*e*. The impeller 51 ejects the sucked in water from the jet nozzle 53 to the rear. The jet nozzle 53 is disposed rearward of the impeller housing 52. A support bracket 53*a* that supports the bucket 6 is fixed to a lateral surface of the jet nozzle 53.

The steering nozzle 54 is disposed rearward of the jet nozzle 53. The steering nozzle 54 includes a jet port 54*a*. A jet of water that propels the vessel body 2 is ejected from the jet port 54*a* to the rear. The steering nozzle 54 is mounted so as to be pivotable right and left. The steering nozzle 54 is configured to switch the ejection direction of a jet of water between right and left in response to the operation of the steering handle 8. Specifically, when the steering handle 8 is turned left, the ejection direction of a jet of water is switched to an obliquely rearward and leftward direction. On the other hand, when the steering handle 8 is turned right, the ejection direction of a jet of water is switched to an obliquely rearward and rightward direction. The steering nozzle 54 may be configured to switch the ejection direction between up and down in response to the operation of a trim adjustor switch mounted to the steering handle 8.

The bucket 6 is disposed rearward of the jet propulsion mechanism 5. The bucket 6 is supported by the support bracket 53*a* while being pivotable up and down about a pivot shaft 6*a* extending to the right and left. The bucket 6 is configured to move to a position away from a jet of water ejected from the jet port 54*a* (hereinafter referred to as "a retracted position") and a position to receive the jet of water ejected from the jet port 54*a* (hereinafter referred to as "a jet receiving position"). In the present exemplary preferred embodiment, the jet receiving position is a concept that encompasses a position in which thrust does not act on the vessel body 2 (hereinafter referred to as "a neutral position", see FIG. 1); and a position in which rearward thrust acts on the vessel body 2 (hereinafter referred to as "a rearward thrust position"). When the bucket 6 is located in the retracted position, a jet of water flows rearward and the vessel body 2 is moved forward. Therefore, the retracted position can be also expressed as a position in which forward thrust acts on the vessel body 2 (hereinafter referred to as "a forward thrust position"). When the bucket 6 is located in the neutral position, the forward thrust and the rearward thrust are cancelled out. Therefore, when the vessel body 2 was not previously moving, the vessel body 2 is maintained in an unmoved state. When the bucket 6 is located in the rearward thrust position, a jet of water mainly flows forward. When the jet of water moves forward, the vessel body 2 is decelerated. On the other hand, when the vessel body 2 was not previously moving, the vessel body 2 is moved backward.

Figure 2:
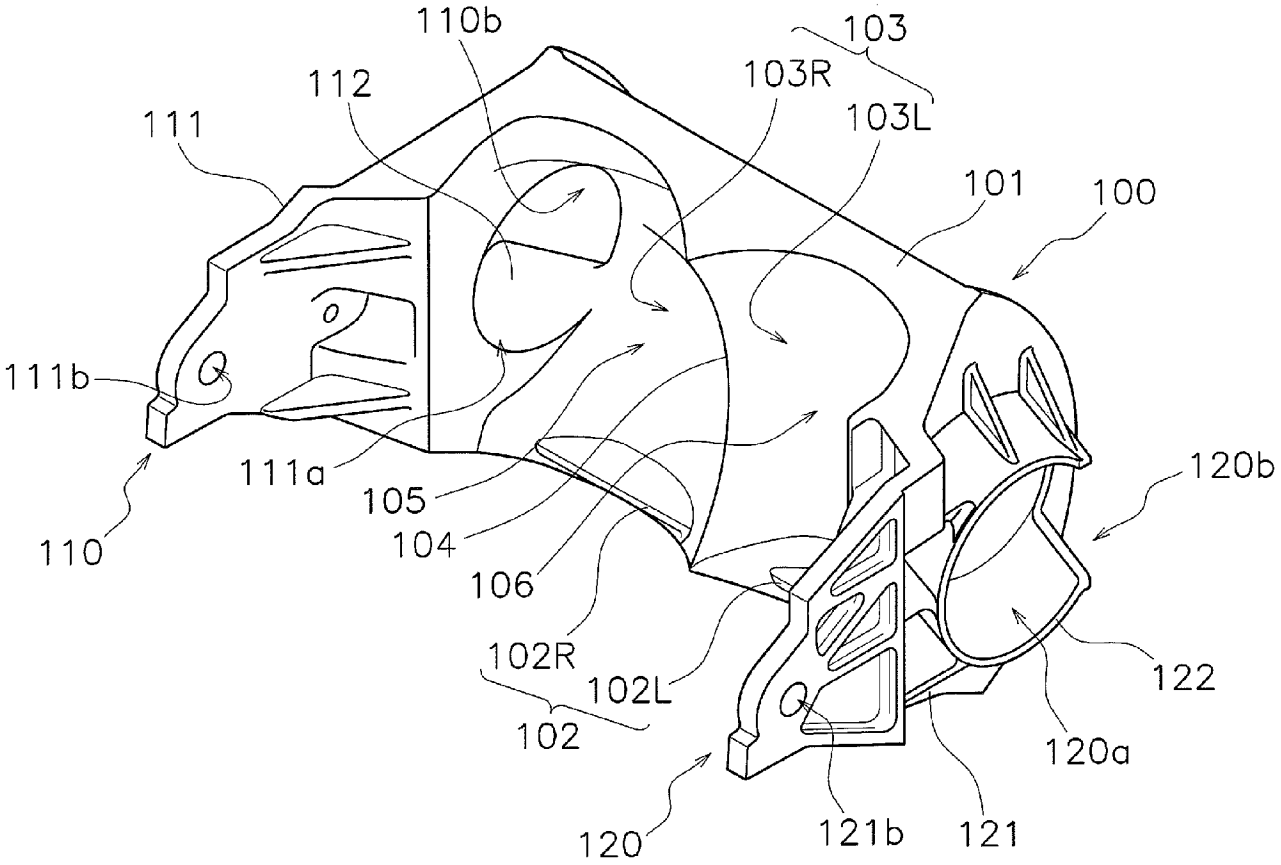
FIG. 2 is a frontal perspective view of a bucket.
Figure 3:
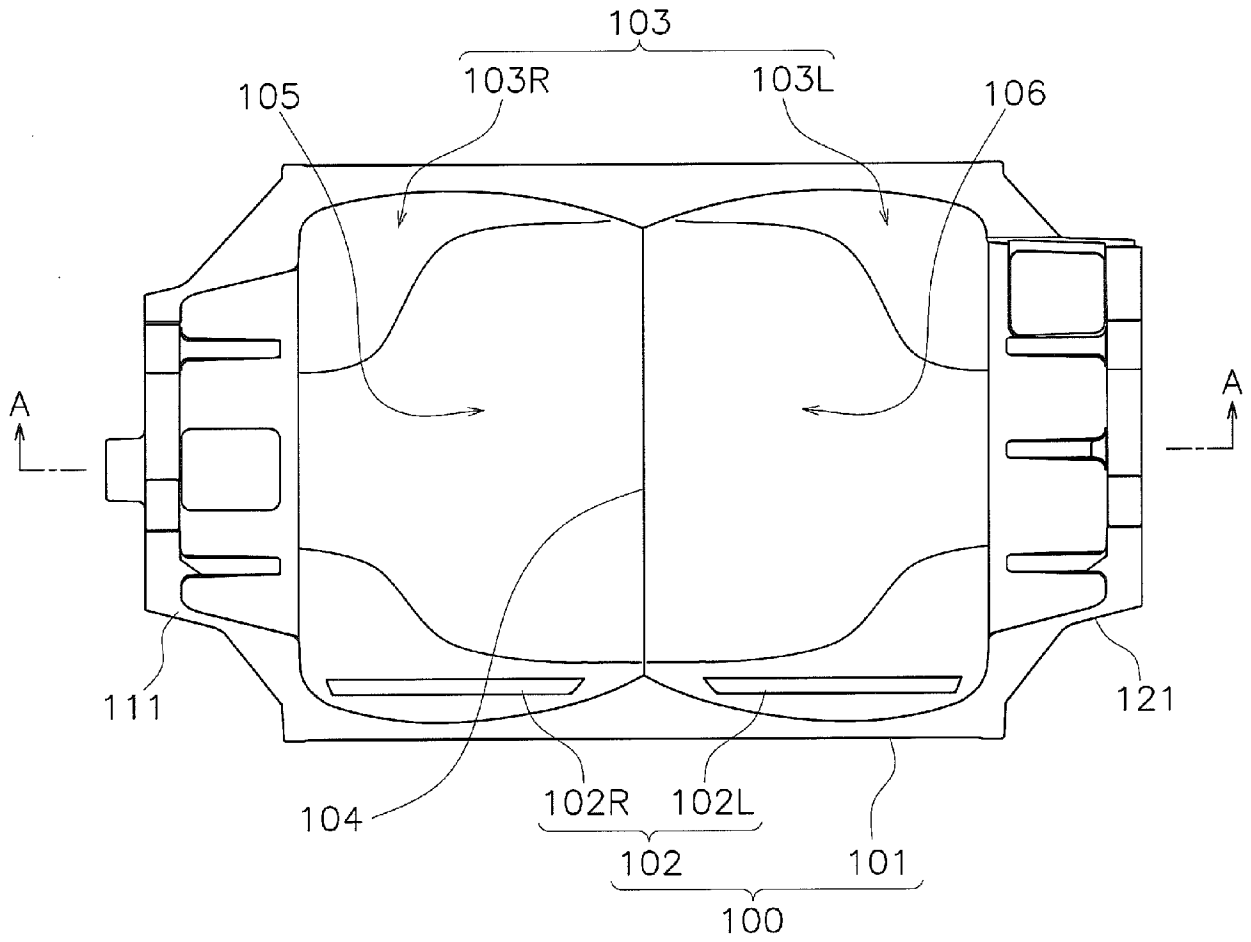
FIG. 3 is a front view of the bucket as seen from the front side.
Figure 4:
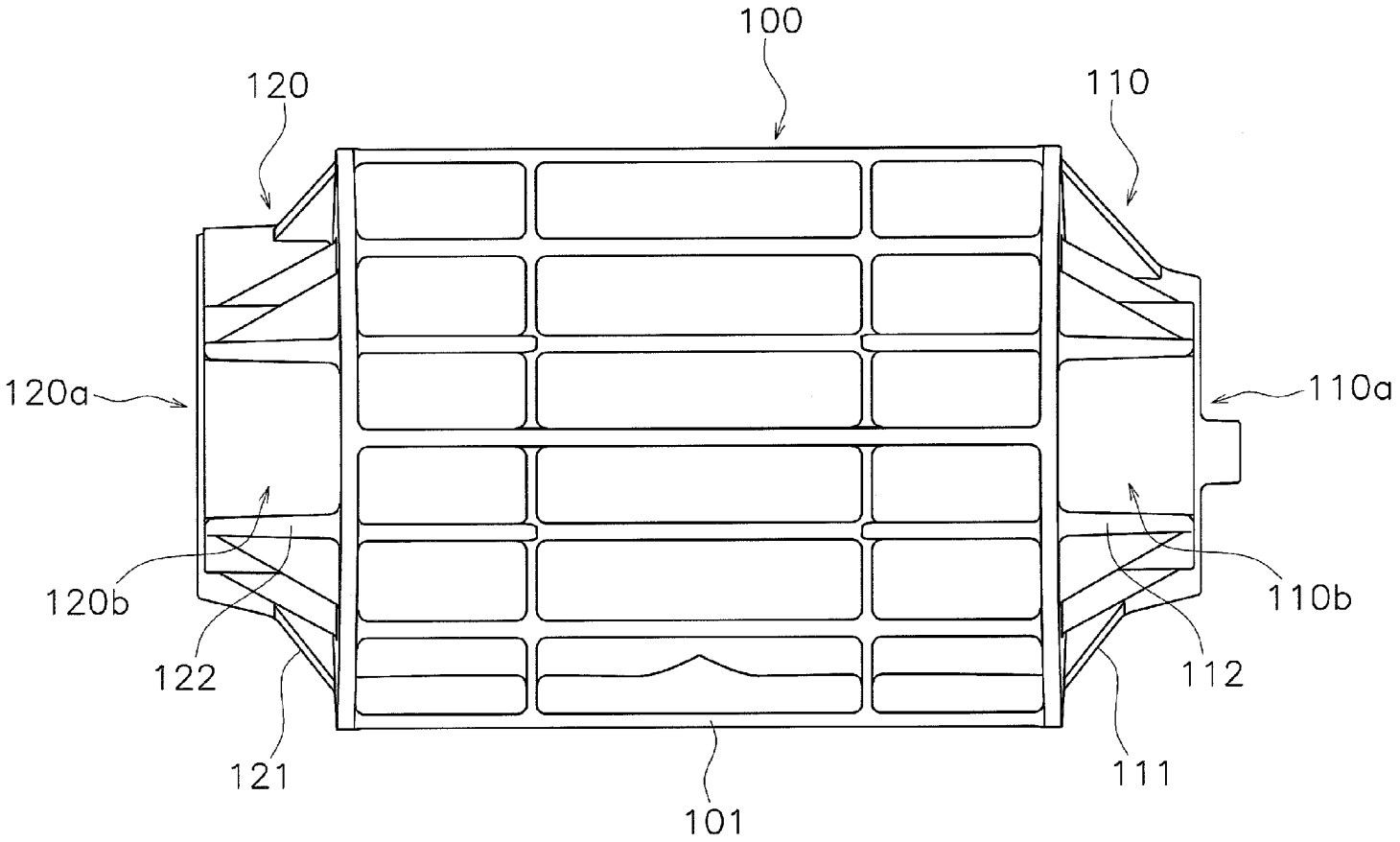
FIG. 4 is a rear view of the bucket as seen from the rear side.
Figure 5:
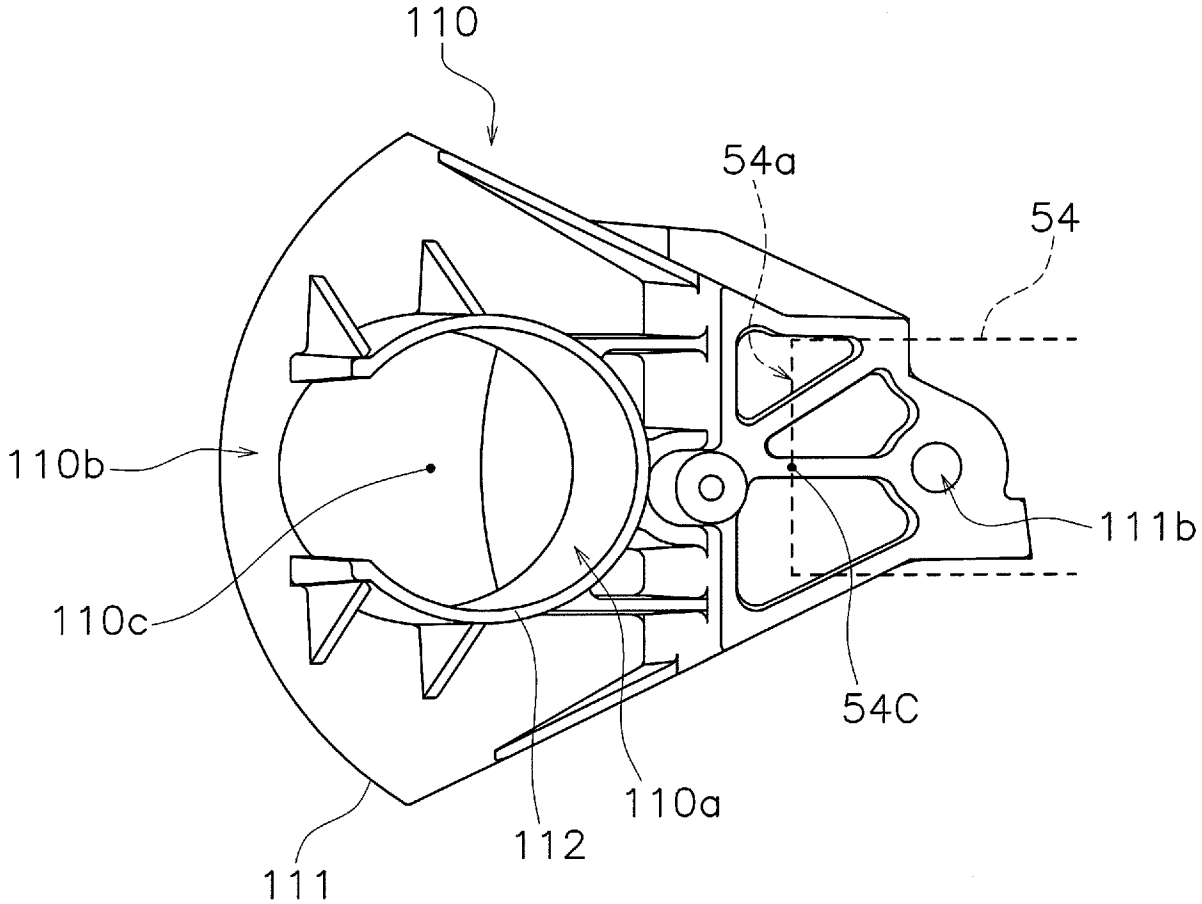
FIG. 5 is a right side view of the bucket as seen from the right side.
Figure 6:
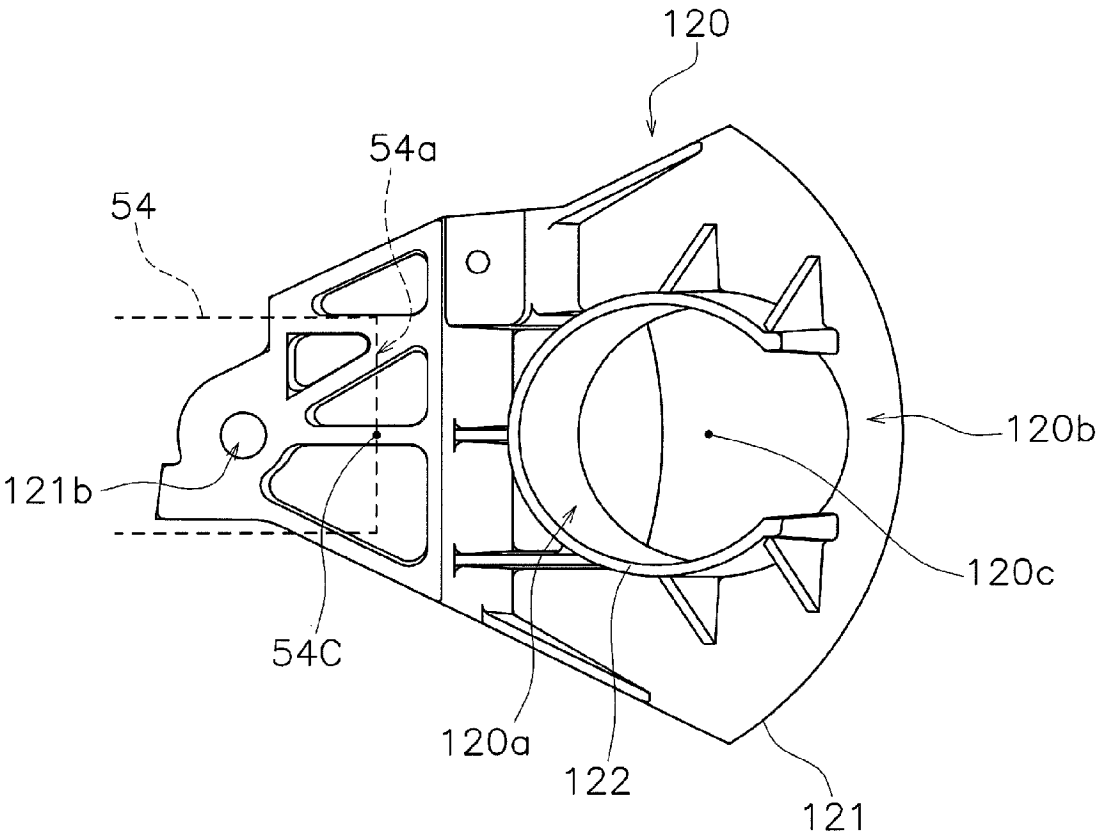
FIG. 6 is a left side view of the bucket as seen from the left side.
Figure 7:
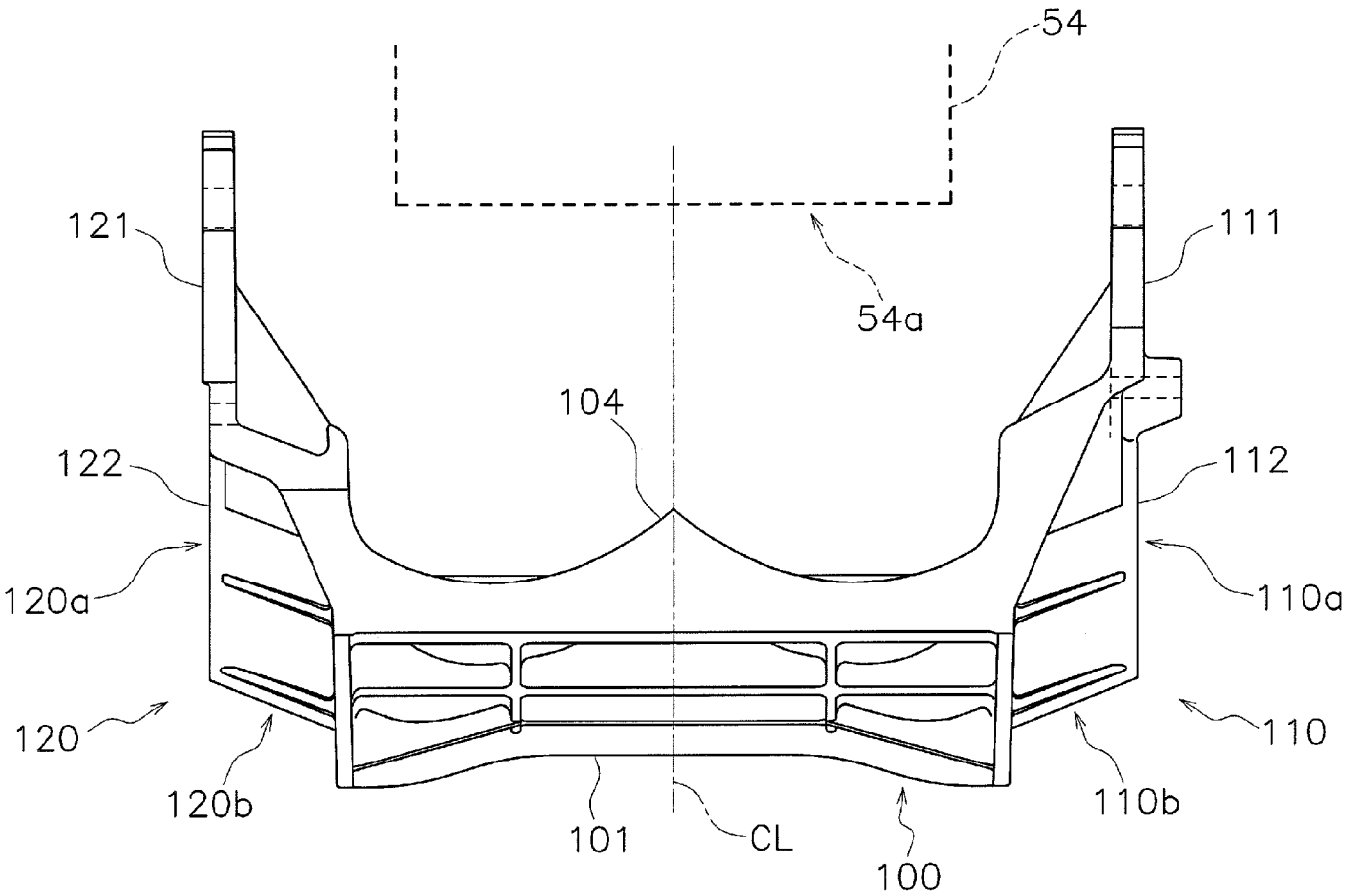
FIG. 7 is a plan view of the bucket as seen from the top side.

FIG. 2 is a frontal perspective view of the bucket 6. FIG. 3 is a front view of the bucket 6 as seen from the front side. FIG. 4 is a rear view of the bucket 6 as seen from the rear side. FIG. 5 is a right side view of the bucket 6 as seen from the right side. FIG. 6 is a left side view of the bucket 6 as seen from the left side. FIG. 7 is a plan view of the bucket 6 as seen from the top side. In FIGS. 5 to 7, the steering nozzle 54 is illustrated for convenience of explanation.

The bucket 6 includes a rear plate portion 100, a right plate portion 110, and a left plate portion 120.

When the bucket 6 is located in the jet receiving position, the rear plate portion 100 is disposed rearward of the steering nozzle 54. In this case, the rear plate portion 100 directs a jet of water ejected from the steering nozzle 54 mainly in the right-and-left direction. In the present exemplary preferred embodiment, the rear plate portion 100 preferably has a configuration that makes a jet of water flow in the right-and-left direction rather than in the up-and-down direction. Specifically, the rear plate portion 100 includes a rear plate 101 and a pair of lower ribs 102.

When the bucket 6 is located in the jet receiving position, the rear plate 101 is opposed to the steering nozzle 54. The rear plate 101 includes an inner surface 103, a middle deflection wall 104, aright recess 105, and a left recess 106. When the bucket 6 is located in the jet receiving position, the inner surface 103 is opposed to the steering nozzle 54. The inner surface 103 includes a right inner surface 103R and a left inner surface 103L. The right inner surface 103R extends rightward of the middle deflection wall 104. The left inner surface 103L extends leftward of the middle deflection wall 104. Each of the right and left inner surfaces 103R and 103L preferably has a curved surface shape.

The middle deflection wall 104 extends up and down between the right inner surface 103R and the left inner surface 103L. The middle deflection wall 104 is located along a center line CL of the width of the vessel body 2 in the right-and-left direction. When a jet of water is ejected from the steering nozzle 54 directly rearward, the middle deflection wall 104 deflects the flow of the jet of water equally right and left. When a jet of water is ejected obliquely rearward and rightward from the steering nozzle 54, the middle deflection wall 104 deflects the flow of the jet of water to the right. When a jet of water is ejected obliquely rearward and leftward from the steering nozzle 54, the middle deflection wall 104 deflects the flow of the jet of water to the left.

The right recess 105 is provided on the right inner surface 103R. The right recess 105 extends rightward from the middle deflection wall 104 towards a right opening 110*a* to be described below. As illustrated in FIG. 3, the right recess 105 preferably has a shape tapered to the right. Therefore, the up-and-down width of the right recess 105 is reduced toward the right opening 110*a*.

The left recess 106 is provided on the left inner surface 103L. The left recess 106 extends leftward from the middle deflection wall 104 toward a left opening 120*a* to be described below. As illustrated in FIG. 3, the left recess 106 preferably has a shape tapered to the left. Therefore, the up-and-down width of the left recess 106 is reduced toward the left opening 120*a*.

Each of the lower ribs 102 preferably has a plate shape and extends to the right and left. The lower ribs 102 are connected to the lower end portion of the rear plate 101. The lower ribs 102 protrude forward from the lower end portion of the rear plate 101. The lower ribs 102 inhibit a jet of water from flowing downward and simultaneously deflecting the flow of the jet of water to the right and left. The lower ribs 102 preferably include a right lower rib 102R and a left lower rib 102L. The right lower rib 102R is mounted to the lower end portion of the right inner surface 103R. The left lower rib 102L is mounted to the lower end portion of the left inner surface 103L.

The right plate portion 110 extends forward from the right end portion of the rear plate portion 100. The right plate portion 110 includes a right plate 111 and a right tube 112.

The right plate 111 is disposed perpendicular or substantially perpendicular to the rear plate 101. Aright discharge port 111*a* and a right insertion hole 111*b* are preferably bored, for example, in the right plate 111. The right discharge port 111*a* is preferably bored in the middle of the rear end portion of the right plate 111. The right insertion hole 111*b* is preferably bored in the front end portion and the right plate 111. The pivot shaft 6*a* (see FIG. 1) is inserted through the right insertion hole 111*b*.

The right tube 112 has a tubular shape and extends to the right discharge port 111*a*. The right tube 112 protrudes rightward from the right plate 111. The right opening 110*a* and a first opening 110*b* are preferably bored, for example, in the right tube 112. The right opening 110*a* opens rightward and allows a jet of water discharged from the right discharge port 111*a* to flow rightward therethrough. As illustrated in FIG. 5, when the rear plate portion 100 is positioned directly rearward of the steering nozzle 54, a center 110C of the right opening 110*a* is preferably positioned at the same height as a center 54C of the jet port 54*a*. The first opening 110*b* is a cutout extending to the right opening 110*a*. As illustrated in FIG. 7, the first opening 110*b* is positioned rightward of the right end of the jetport 54*a*. The first opening 110*b* opens rearward and allows a portion of the jet of water discharged from the right discharge port 111*a* to flow rearward therethrough. Explanation will be made below of the amount of the jet of water passing through the right opening 110*a* and the amount of the jet of water passing through the first opening 110*b*.

The left plate portion 120 extends forward from the left end portion of the rear plate portion 100. The left plate portion 120 includes a left plate 121 and a left tube 122.

The left plate 121 is disposed perpendicular or substantially perpendicular to the rear plate 101. A left discharge port 121*a* and a left insertion hole 121*b* are preferably bored, for example, in the left plate 121. The left discharge port 121*a* is preferably bored in the center of the rear end portion of the left plate 121. The left insertion hole 121*b* is preferably bored in the front end portion of the left plate 121. The pivot shaft 6*a* is inserted through the left insertion hole 121*b*.

The left tube 122 has a tubular shape and extends to the left discharge port 121*a*. The left tube 122 protrudes leftward from the left plate 121. The left opening 120*a* and a second opening 120*b* are preferably bored in the left tube 122. The left opening 120*a* is positioned on the opposite side of the right opening 110*a*. The left opening 120*a* opens leftward and allows a jet of water discharged from the left discharge port 121*a* to flow leftward therethrough. As illustrated in FIG. 6, when the rear plate portion 100 is positioned directly rearward of the steering nozzle 54, a center 120C of the left opening 120*a* is preferably positioned at the same height as the center 54C of the jet port 54*a*. The second opening 120*b* is a cutout extending to the left opening 120*a*. The second opening 120*b* is spaced apart from the first opening 110*b*. As illustrated in FIG. 7, the second opening 120*b* is positioned rearward of the left end of the jet port 54*a*. The second opening 120*b* opens rearward and allows a portion of a jet of water discharged from the left discharge port 121*a* to flow rearward therethrough. Explanation will be made below of the amount of the jet of water passing through the left opening 120*a* and the amount of the jet of water passing through the second opening 120*b*.

Figure 8:
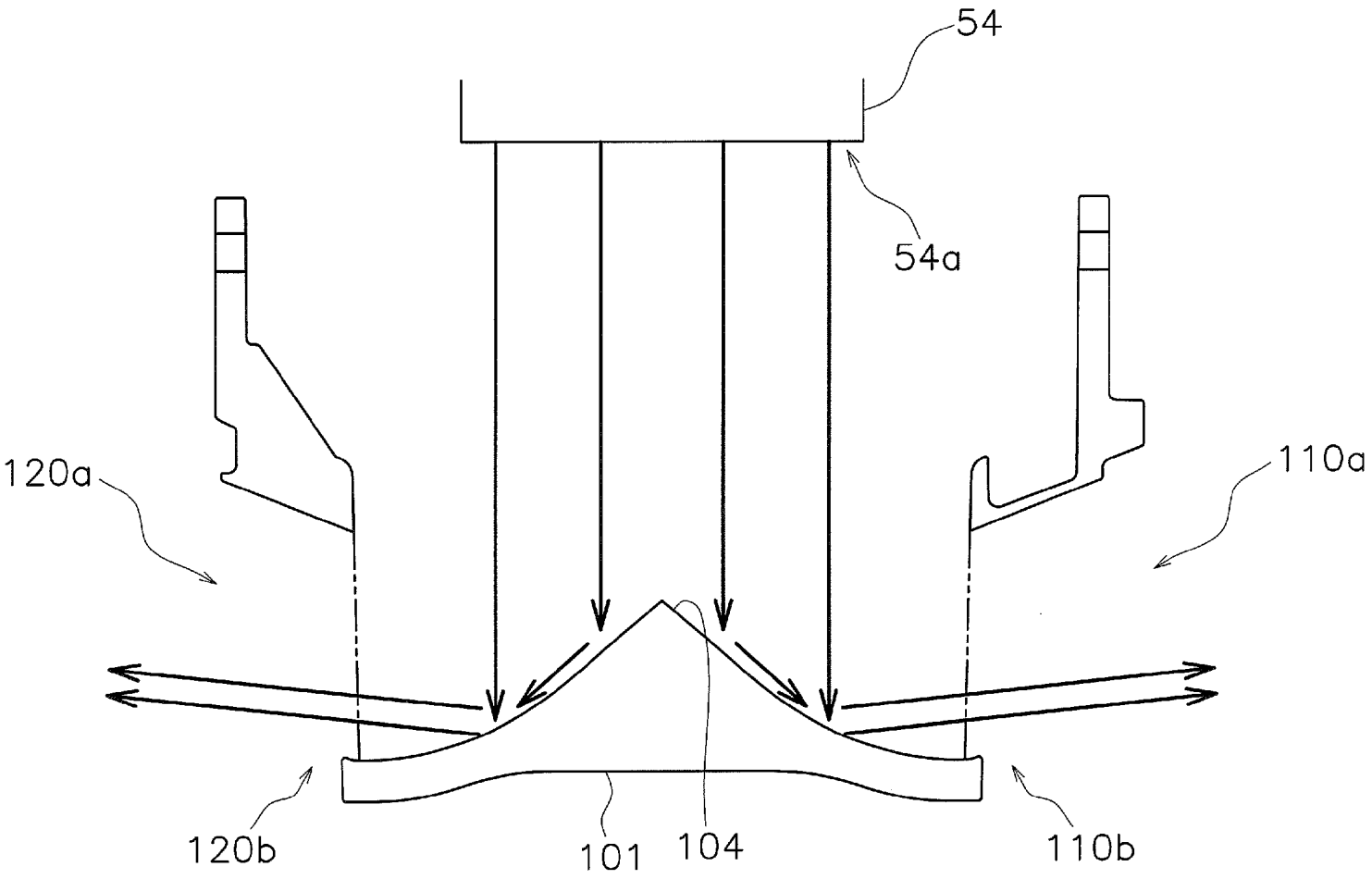
FIG. 8 is a schematic diagram illustrating a flow of a jet of water.
Figure 9:
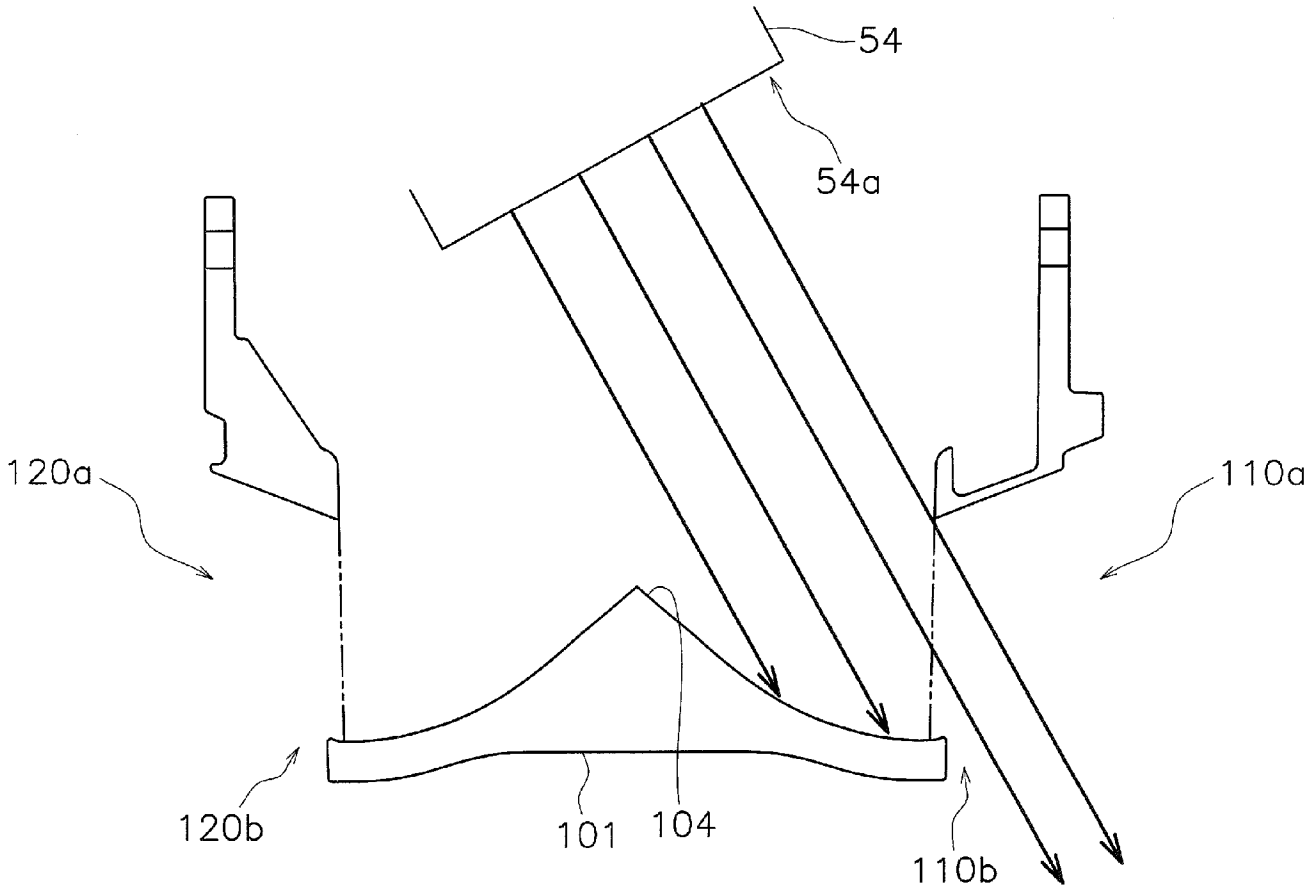
FIG. 9 is a schematic diagram illustrating a flow of a jet of water.
Figure 10:
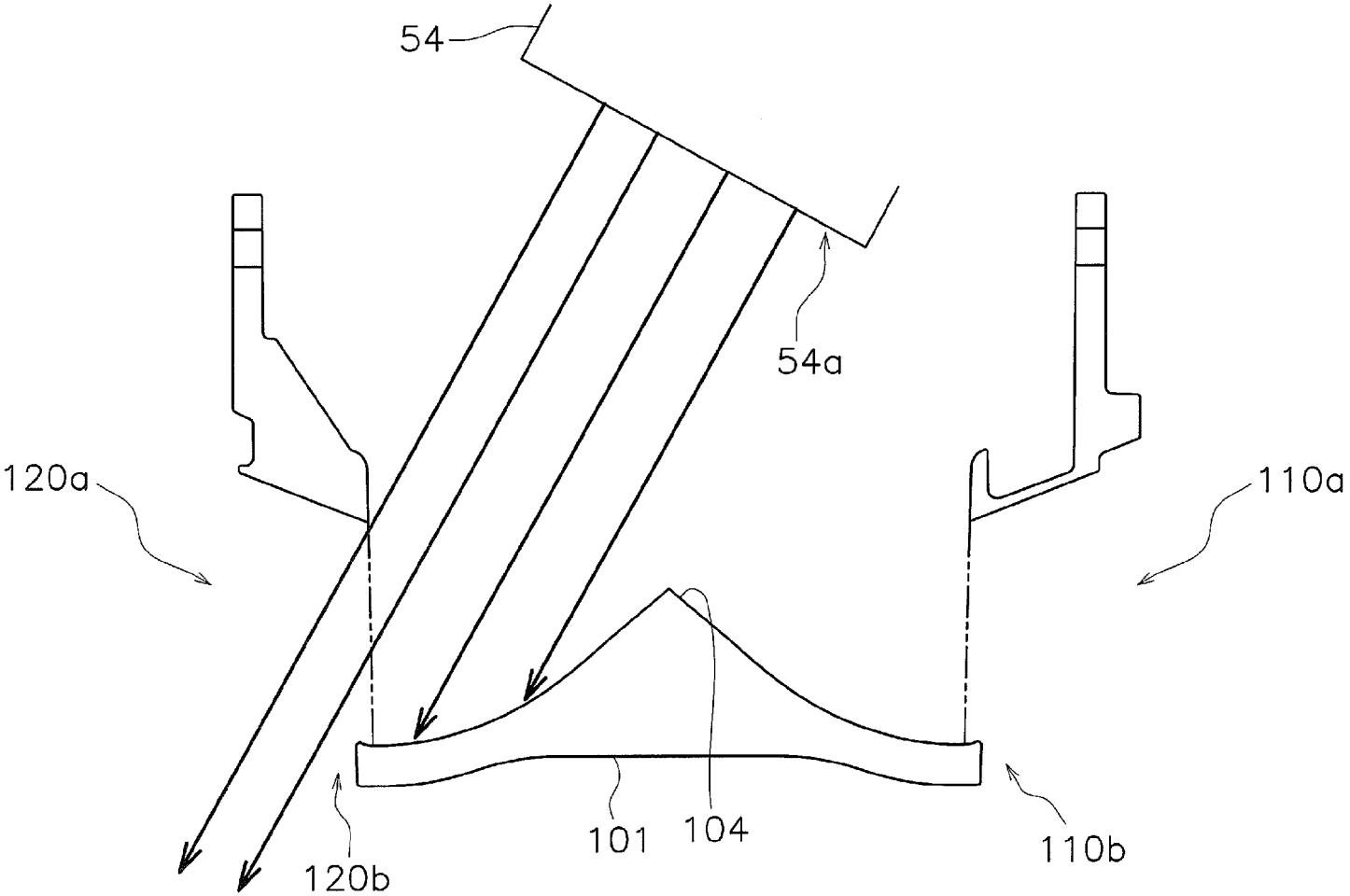
FIG. 10 is a schematic diagram illustrating a flow of a jet of water.

FIGS. 8 to 10 are schematic diagrams depicting the flow of a jet of water with arrows. FIGS. 8 to 10 illustrate the cross-section of the bucket 6 (see a line A-A in FIG. 3) located in the jet receiving position.

As illustrated in FIG. 8, when the steering nozzle 54 is directed immediately rearward, a jet of water is ejected directly rearward. In this case, the jet of water preferably is equally deflected right and left by the middle deflection wall 104, for example. Most of the jet of water deflected rightward is ejected rightward from the right discharge port 111*a* through the right opening 110*a*. Most of the jet of water deflected leftward is ejected leftward from the left discharge port 121*a* through the left opening 120*a*. Thus, a jet of water is hardly ejected rearward through the first opening 110*b* and the second opening 120*b*.

As illustrated in FIG. 9, when the steering nozzle 54 is pivoted at the rightmost angle, a jet of water is ejected obliquely rearward and rightward. The first opening 110*b* is partially positioned in the ejection direction. Therefore, a portion of the jet of water is ejected obliquely rearward and rightward from the first opening 110*b*, whereas the remaining portion of the jet of water is ejected rightward through the right opening 110*a*.

As illustrated in FIG. 10, when the steering nozzle 54 is pivoted at the leftmost angle, a jet of water is ejected obliquely rearward and leftward. The second opening 120*b* is partially positioned in the ejection direction. Therefore, a portion of the jet of water is ejected obliquely rearward and leftward from the second opening 120*b*, whereas the remaining portion of the jet of water is ejected through the left opening 120*a*.

The bucket 6 preferably includes the right opening 110*a*, the first opening 110*b*, the left opening 120*a*, and the second opening 120*b*. When the bucket 6 is located in the jet receiving position, the right opening 110*a* allows a jet of water to flow rightward therethrough while the right opening 110*a* allows a jet of water to flow rearward therethrough. When the bucket 6 is located in the jet receiving position, the left opening 120*a* allows a jet of water to flow leftward therethrough while the second opening 120*b* allows a jet of water to flow rearward therethrough.

Thus, if the steering nozzle 54 is pivoted right and left while the vessel body 2 is decelerated by ejecting a jet of water right and left, in other words, while the bucket 6 is in use, a portion of the jet of water is allowed to be expelled rearward through either the right opening 110*a* and the left opening 120*a*. Therefore, it is possible to inhibit such a situation that a jet of water is ejected through either the right opening 110*a* or the left opening 120*a* at an excessive momentum to cause the vessel body 2 to make an acute turn.

The bucket 6 includes the rear plate portion 100, the right plate portion 110, and the left plate portion 120. When the bucket 6 is located in the jet receiving position, the rear plate portion 100 is disposed rearward of the steering nozzle 54. The rear plate portion 100 directs a jet of water at least in the right-and-left direction. The right opening 110*a* is preferably bored in the right plate portion 110, whereas the left opening 120*a* is preferably bored in the left plate portion 120.

Therefore, a jet of water is ejected right and left with a simple structure.

The first opening 110*b* is preferably bored in the right plate portion 110, specifically in the right tube 112, whereas the second opening 120*b* is preferably bored in the left plate portion 120, specifically in the left tube 122.

Therefore, the first opening 110*b* and the second opening 120*b* are further spaced apart to the right and left away from the jet port 54*a* in comparison with openings bored in the rear plate portion 100. Hence, the flexibility of locating the positions of the first and second openings 110*b* and 120*b* is enhanced. This makes it easy to configure a jet of water to be ejected only rearward when the steering nozzle 54 is pivoted right and left.

The first opening 110*b* is preferably a cutout extending to the right opening 110*a*, whereas the second opening 120*b* is preferably a cutout extending to the left opening 120*a*.

Therefore, the first opening 110*b* and the right opening 110*a* are integral, while the second opening 120*b* and the left opening 120*a* are integral. Thus, it is possible to further simplify a jig and further reduce the number of processing steps in comparison with the structure in which the aforementioned elements are separate components.

When the steering nozzle 54 is pivoted at the rightmost angle, the first opening 110*b* is partially positioned in the ejection direction of a jet of water. When the steering nozzle 54 is pivoted at the leftmost angle, the second opening 120*b* is partially positioned in the ejection direction of a jet of water.

Therefore, when the steering nozzle 54 is pivoted right and left, it is possible to make a portion of the jet of water to be expelled rearward through either the right opening 110*a* or the left opening 120*a*.

The rear plate portion 100 has a shape that makes a jet of water flow in the right-and-left direction rather than in the up-and-down direction.

Thus, a jet of water becomes more likely to flow right and left, and it is possible to increase the right-and-left directional flow of a jet of water. Accordingly, the vessel body 2 is efficiently decelerated. It should be noted that even in the aforementioned preferred embodiments, a portion of the jet of water is allowed to be expelled rearward through either the right opening 110*a* or the left opening 120*a*. Therefore, the vessel body 2 is inhibited from making an acute turn.

The right recess 105 and the left recess 106 are provided on the inner surface 103 of the rear plate portion 100. The right recess 105 extends rightward from the middle deflection wall 104 towards the right opening 110*a*. The left recess 106 extends leftward from the middle deflection wall 104 towards the left opening 120*a*.

Therefore, a jet of water becomes more likely to flow right and left, and it is possible to further increase the right-and-left directional flow of a jet of water.

The rear plate portion 100 includes the lower ribs 102 that protrude forward from the lower end portion of the rear plate 101.

Therefore, a jet of water becomes more likely to flow right and left, and it is possible to further increase the right-and-left directional flow of a jet of water.

When the rear plate portion 100 is positioned directly rearward of the steering nozzle 54, the center 110C of the right opening 110*a* and the center 120C of the left opening 120*a* are preferably positioned at the same height as the center 54C of the jet port 54*a*.

Therefore, it is possible to further increase the right-and-left directional flow of a jet of water in comparison with the structure that the center 110C of the right opening 110*a* and the center 120C of the left opening 120*a* are positioned at a height different from that of the center 54C of the jet port 54*a*.

Exemplary preferred embodiments of the present invention have been described above. However, the present invention is not limited to the aforementioned exemplary preferred embodiments, and a variety of changes can be made without departing from the scope of the present invention.

In the aforementioned exemplary preferred embodiments, the first opening 110*b* preferably is designed as a cutout extending to the right opening 110*a*, and the second opening 120*b* is designed as a cutout extending to the left opening 120*a*. However, the structures of the first opening 110*b* and that of the second opening 120*b* are not limited to the above. The first opening 110*b* and the second opening 120*b* may be holes, respectively. In this case, the first opening 110*b* can be bored, for example, in either the rear plate portion 100 or the right plate portion 110, and the second opening 120*b* can be bored, for example, in either the rear plate portion 100 or the left plate portion 120.

It should be noted that, when the first opening 110*b* is bored in either the rear plate portion 100 or the right plate portion 110, the right plate portion 110 may not include the right tube 112. Likewise, when the second opening 120*b* is bored in either the rear plate portion 100 or the left plate portion 120, the left plate portion 120 may not include the left tube 122.

In the aforementioned exemplary preferred embodiments, the first opening 110*b* preferably is entirely positioned rightward of the right end of the jet port 54*a*, and the second opening 120*b* is entirely positioned leftward of the left end of the jet port 54*a*. However, the positions of the first opening 110*b* and that of the second opening 120*b* are not limited to the above. The first opening 110*b* may be only partially positioned rightward of the right end of the jet port 54*a*, and the second opening 120*b* may be only partially positioned leftward of the left end of the jet port 54*a*.

In the aforementioned exemplary preferred embodiments, the jet receiving position encompasses both of the neutral position and the rearward thrust position. However, the jet receiving position may be either the neutral position or the rearward thrust position.

In the aforementioned exemplary preferred embodiments, the jet propulsion mechanism 5 is designed to include the jet nozzle 53 and the steering nozzle 54 as separate components. However, when the jet nozzle 53 is configured to be pivoted in response to the operation of the steering handle 8, the steering nozzle 54 is not necessarily required.

In the aforementioned exemplary preferred embodiments, an exemplary structure of the bucket 6 has been described in detail with reference to the drawings. However, the detailed structure of the bucket 6 can be arbitrarily changed as long as the bucket 6 includes the right and left openings 110*a* and 120*a* to ejecting a jet of water right and left, and the first and second openings 110*b* and 120*b* to allow a jet of water to be expelled rearward when the steering nozzle 54 is pivoted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propulsion watercraft comprising:

a vessel body;

a steering nozzle configured to be pivoted right and left, the steering nozzle including a jet port from which a jet of water is ejected to propel the vessel body; and a bucket configured to move to a retracted position spaced away from the jet of water ejected from the jet port and to a jet receiving position to receive the jet of water ejected from the jet port; wherein the bucket includes a rear plate portion, a right plate portion, a left plate portion, a right opening, a left opening, a first opening, and a second opening;

the rear plate portion is disposed rearward of the steering nozzle and directs the jet of water at least in a right-and-left direction when the bucket is located in the jet receiving position;

the right plate portion extends forward from a right end portion of the rear plate portion;

the left plate portion extends forward from a left end portion of the rear plate portion;

the right opening is bored in the right plate portion;

the left opening is bored in the left plate portion;

the first opening is a hole in either the rear plate portion or the right plate portion; and the second opening is a hole in either the rear plate portion or the left plate portion and is spaced apart from the first opening;

the first opening is located at least partially rightward of a right end of the jet port; and the second opening is located at least partially leftward of a left end of the jet port;

the jet of water ejected from the jet port flows rightward from the right opening and flows rearward from the first opening when the bucket is located in the jet receiving position and the steering nozzle is pivoted right; and the jet of water ejected from the jet port flows leftward from the left opening and flows rearward from the second opening when the bucket is located in the jet receiving position and the steering nozzle is pivoted left.

2. The jet propulsion watercraft according to claim 1, wherein the right plate portion includes a right plate extending to the right end portion of the rear plate portion and a right tube protruding rightward from the right plate;

the left plate portion includes a left plate extending to the left end portion of the rear plate portion and a left tube protruding leftward from the left plate;

the right tube includes the right opening and the first opening therein; and the left tube includes the left opening and the second opening therein.

3. The jet propulsion watercraft according to claim 1, wherein the first opening is located at least partially in an ejection direction of the jet of water ejected from the steering nozzle when the steering nozzle is pivoted to a rightmost angle; and the second opening is located at least partially in an ejection direction of the jet of water ejected from the steering nozzle when the steering nozzle is pivoted to a leftmost angle.

4. The jet propulsion watercraft according to claim 1, wherein a center of the right opening and a center of the left opening are located at a same height as a center of the jet port of the steering nozzle when the rear plate portion is located directly rearward of the steering nozzle.

5. The jet propulsion watercraft according to claim 1, wherein the rear plate portion has a configuration to make the jet of water ejected from the steering nozzle to flow in the right-and-left direction rather than in an up-and-down direction.

6. The jet propulsion watercraft according to claim 5, wherein the rear plate portion includes an inner surface opposed to the steering nozzle when the bucket is located in the jet receiving position, and the inner surface includes a right recess extending towards the right opening and a left recess extending towards the left opening.

7. The jet propulsion watercraft according to claim 5, wherein the rear plate portion includes a rear plate opposed to the steering nozzle when the bucket is located in the jet receiving position and a lower rib protruding forward from a lower end portion of the rear plate.

* * * * *